US011378898B2

(12) United States Patent
Abramsohn

(10) Patent No.: US 11,378,898 B2
(45) Date of Patent: Jul. 5, 2022

(54) MAGNETIC CARRIER BEAD SEPARATION

(71) Applicant: HEWLETT-PACKARD DEVELOPMENT COMPANY, L.P., Spring, TX (US)

(72) Inventor: Dennis Alan Abramsohn, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/254,017

(22) PCT Filed: Nov. 16, 2018

(86) PCT No.: PCT/US2018/061506

§ 371 (c)(1),
(2) Date: Dec. 18, 2020

(87) PCT Pub. No.: WO2020/101700

PCT Pub. Date: May 22, 2020

(65) Prior Publication Data

US 2021/0263447 A1 Aug. 26, 2021

(51) Int. Cl.
*G03G 15/08* (2006.01)
*G03G 15/09* (2006.01)

(52) U.S. Cl.
CPC ..... *G03G 15/0893* (2013.01); *G03G 15/0844* (2013.01); *G03G 15/09* (2013.01); *G03G 15/0921* (2013.01); *G03G 2215/0607* (2013.01)

(58) Field of Classification Search
CPC ..... G03G 15/0893; G03G 15/09; G03G 15/0844; G03G 15/0853; G03G 15/0921; G03G 2215/0607; G03G 2215/0609
See application file for complete search history.

(56) References Cited

U.S. PATENT DOCUMENTS 2,961,932 A * 11/1960 Francis ..... G03G 15/09 399/146
4,470,694 A * 9/1984 Murakami ..... G03G 21/0047 15/1.51
5,184,194 A * 2/1993 Mosehauer ..... G03G 15/0928 399/279
5,283,615 A 2/1994 Yokoyama
5,440,376 A * 8/1995 Hagihara ..... G03G 15/0844 399/120

(Continued)

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

Examples disclosed herein relate to magnetic carrier bead separation in dual-component printing. The present disclosure relates generally to a device, method, and system for magnetic carrier bead separation. In an example, a printing device includes a developer sump to hold a plurality of carrier beads. The example device also includes a roller to move a subset of the plurality of carrier beads from an attachment point on the roller to a release point through a rotation of the roller, wherein the subset of the plurality of carrier beads return towards the developer sump after they are released at the release point. The device includes a magnetic separator located between the release point and the attachment point that guides a magnetized carrier bead of the plurality of carrier beads away from the developer sump and the roller.

11 Claims, 6 Drawing Sheets

(56) References Cited

U.S. PATENT DOCUMENTS

| | | | | |
|---|---|---|---|---|
| 5,506,372 | A * | 4/1996 | Guth | G03G 15/0822 399/254 |
| 7,142,798 | B2 | 11/2006 | Martin | |
| 7,182,861 | B2 | 2/2007 | Sugiyama et al. | |
| 7,493,067 | B2 | 2/2009 | Wegman | |
| 8,475,988 | B2 | 7/2013 | Sugiura et al. | |
| 9,256,162 | B2 | 2/2016 | Campbell et al. | |
| 9,557,682 | B2 | 1/2017 | Sugiura et al. | |
| 2005/0002699 | A1 | 1/2005 | Tamura | |
| 2006/0045571 | A1 | 3/2006 | Matsuura | |
| 2009/0067878 | A1 * | 3/2009 | Tateyama | G03G 15/0893 399/111 |
| 2012/0014718 | A1 | 1/2012 | Ikeda | |
| 2017/0308004 | A1 | 10/2017 | Ariizumi | |

* cited by examiner

APPROVED: /LKR/

300

500

MAGNETIC CARRIER BEAD SEPARATION

BACKGROUND

A dual-component printer makes use of toner and carrier beads in electrophotographic printing systems. Toner particles are held to carrier beads through primarily electrostatic forces. Carrier beads tend to form chainlike bristles in the presence of magnetic fields. The carrier beads and any formed carrier bead chains can temporarily attach to a roller due to transporting magnets located within the roller. The roller may rotate in order to apply the carrier beads and toner against organic photo conductor before the carrier beads may be released for return to a developer sump.

DESCRIPTION OF THE DRAWINGS

Certain examples are described in the following detailed description and in reference to the drawings, in which.

DETAILED DESCRIPTION

This present disclosure relates to a method, device, and system in dual-component printing that separates carrier beads with a magnetic separator by utilizing the magnetic properties that carrier beads gain over their time-of-use. As used herein, the term magnetic refers to items which are affected by magnetic fields. The term magnetic does not necessarily imply that permanent or semi-permanent magnetic fields are formed by an item described as magnetic. While a magnetic item may include items that produce magnetic fields, the use of the phrase 'magnetic items' in this disclosure also includes items that can be attracted to magnets or items to which magnets are attracted. In an example, an item made of iron would be considered magnetic even when it is not generating a magnetic field as the item of iron would attract magnets or other items acting as magnets. The magnetic separator referred to in this disclosure includes items made of materials that attract magnetized items. Magnetized items are items that produce magnetic fields. In an example, magnetized items are items exhibiting qualities of magnets and can include permanent magnets, induced magnets, and other items caused to take on the properties of magnets. In an example, a piece of iron may become magnetized through repeated rubbing of a magnet against the iron in order to align the magnetic domains of the iron to produce a larger field of magnetic effects coming from the now magnetized iron.

Figure 1A:
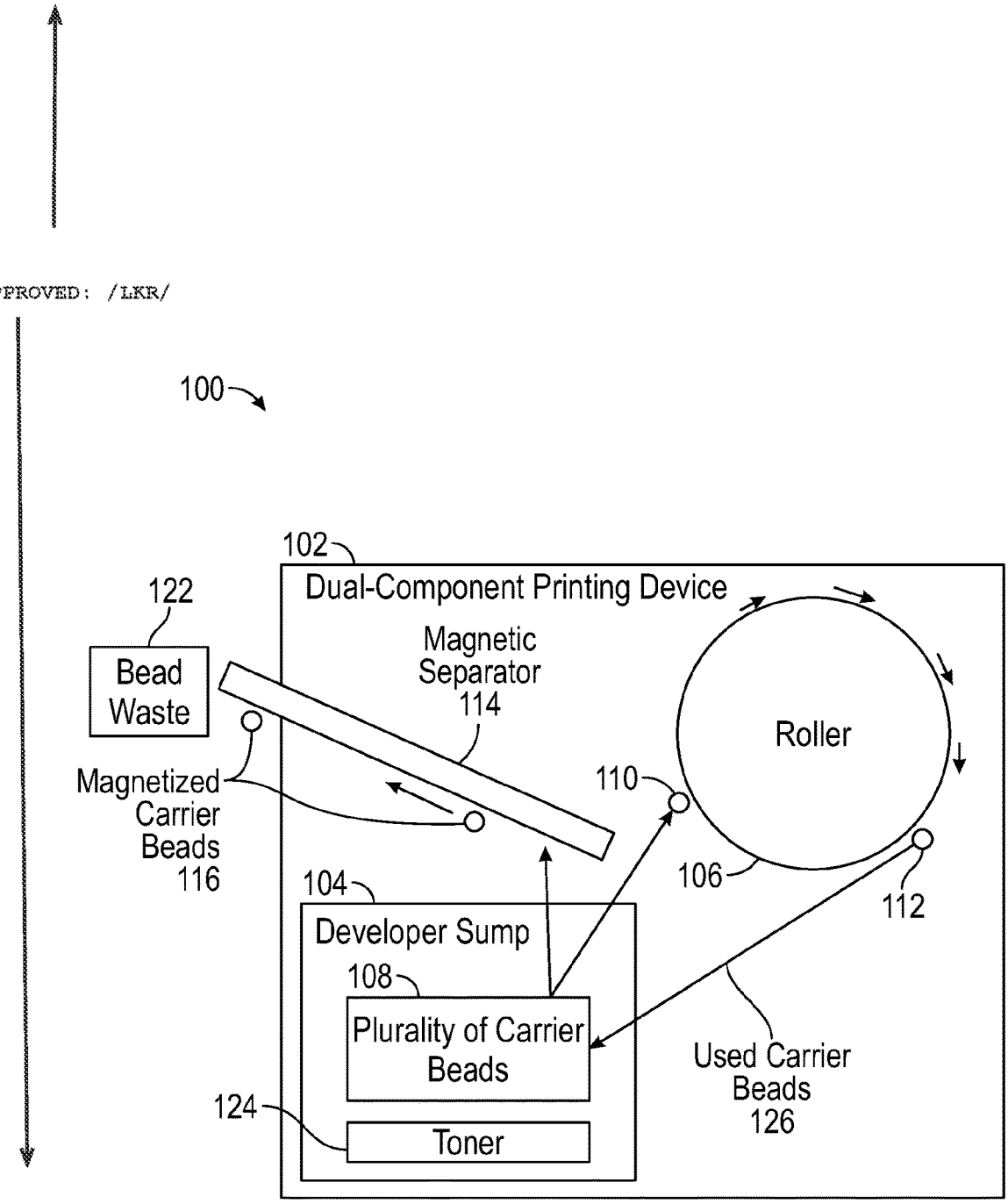
FIG. 1A is a block diagram of an example dual-component printing device that separates carrier beads with a magnetic separator by magnetic properties gained over the time-of-use of the carrier beads.
Figure 1B:
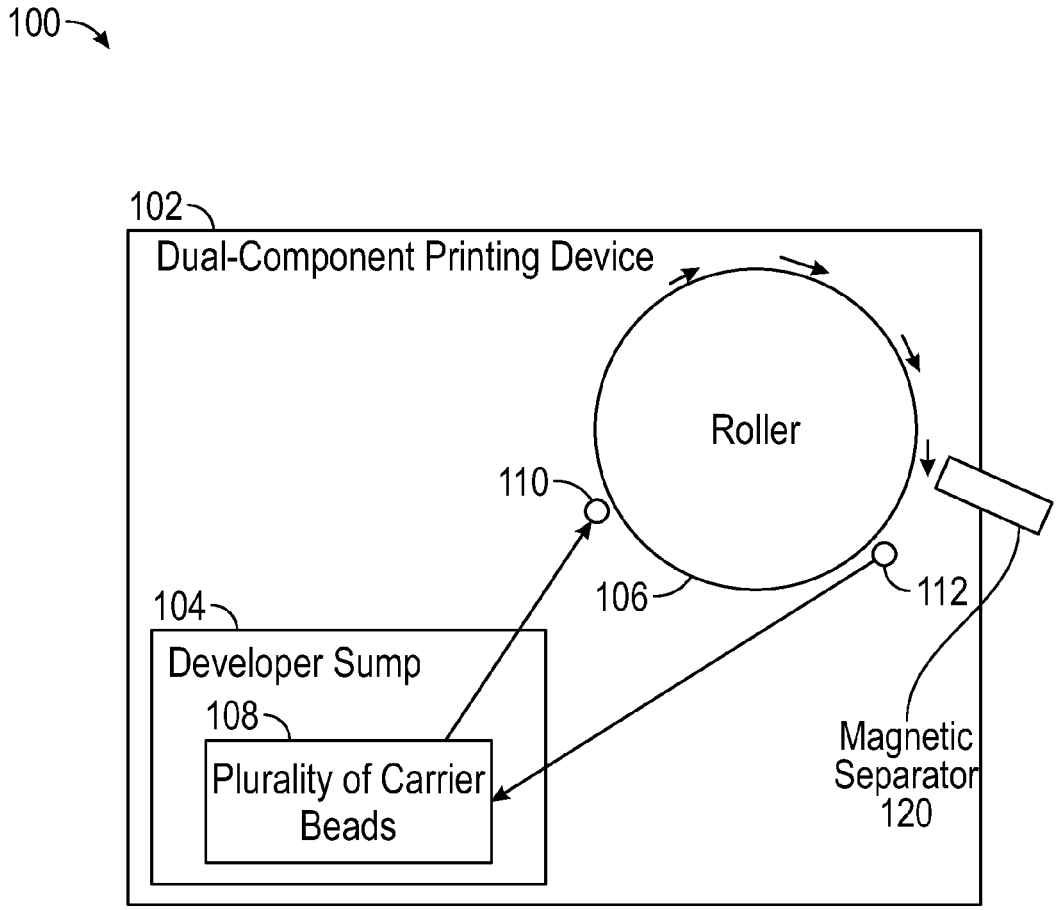
FIG. 1B is a block diagram of another example dual-component printing device that separates carrier beads with a magnetic separator by magnetic properties gained over the time-of-use of the carrier beads.

FIG. 1A is a block diagram of an example 100 dual-component printing device that separates carrier beads with a magnetic separator by magnetic properties gained over the time-of-use of the carrier beads. The dual-component printing device 102 operates through use of the two components, carrier and toner. As used herein, carrier refers generally to the large number of microscopic carrier beads that are one of the two-components in the dual component printing device 102. As used herein, toner refers generally to the large number of toner particles that attach to carrier beads as a result of electrostatic forces. In an example, carrier beads can be polymer coated and may also be magnetic. Carrier beads may be attracted to magnets or magnetic fields. In the presence of magnetic fields, carrier beads may form bristle like chains with one another. The toner may stay attached to the carrier bead until rubbed, applied, or attracted to the surface of organic photo conductor (OPC) or other non-organic photo conductive materials. Throughout this application, reference to OPC can also include other non-organic photo conductive materials, however OPC may be referenced for ease of reference. The carrier beads, collectively referred to as carrier, and the toner particles, collectively referred to as toner, may be stored or held in a developer sump 104. The developer sump 104 may be a bin that has input holes, valves, or ports so that additional carrier and toner may be added. The developer sump 104 may be a tangible container including walls and the holding space enclosed or partially enclosed by walls. Carrier (including a plurality of carrier beads 108) and toner 124 inside the developer sump 104 may be pulled out by magnets held inside a roller 106. In an example, the roller 106 may be a naturally non-magnetic material such as aluminum. The plurality of carrier beads 108 that make up the carrier may be stored in the developer sump 104. The carrier may attach to the roller 106 at an attachment point 110. The roller 106 may rotate in place so that the carrier beads are rotated to brush against an OPC where the toner transfers to the OPC while the carrier beads remain attracted to magnets located under the roller 106. At the release point 112 located on the path of the roller 106, the carrier beads are released as magnets are not located underneath the release point 112 of the roller. After carrier has been released at the release point, the released carrier beads (which are used carrier beads 126) and remaining toner returns to the developer sump 104. The plurality of carrier beads 108 located in the developer sump 104 includes both unused carrier beads and used carrier beads that were applied to the OPC through the motion of the roller 106 moving the carrier and locating the carrier and toner adjacent to the OPC. The point of application may be referred to as an attachment point. In an alternative example, rather than wait for the carrier or toner to detach at a release point, a magnetic separator (shown as 120 in FIG. 1B) may be located after the application point and before the release point 112 in contrast to machines that allow magnetized carrier beads to return towards the development sump 104.

Over time and through repeated use, carrier beads can become magnetized. In an example, the repeated and durational exposure of the carrier beads to the magnets located inside the roller 106, can result in magnetized carrier beads. The effects of this magnetization on the carrier beads increase the strength of carrier bead magnetization over time and the frequency of carrier bead use. Accordingly, the older and more frequently a carrier bead is used, the more it becomes magnetized. Older, more frequently used carrier beads may exhibit properties of induced magnets. Using this induced magnet property is useful in separating older carrier beads from fresher carrier beads. As older carrier beads may have toner impacted on their surface, these carrier beads may be poorer in their function of carrying toner to the OPC along the path of the roller 106. Accordingly, separation of older carrier beads enables disposal and replacement of these older beads rather than disposal of both old and fresh carrier beads.

One technique for separating out older carrier beads disclosed herein is through the use of a magnetic separator 114 (or 120). As discussed and distinguished above, the magnetic separator may or may not be magnetized. The term magnetic in magnetic separator refers to a property that the separator possesses, that it interacts with magnetic fields. In an example, this can mean that the magnetic separator 114 is attracted to magnetized items. Likewise, magnetized items, such as a magnetized carrier bead may be attracted to the magnetic separator 114.

In an example, the magnetic separator 114 may take the form of an inverted ramp located above the development sump 104 that is holding the plurality of carrier beads 108. The magnetic separator 114 is located in propinquity to the development sump 104 such that a magnetized carrier bead is attracted to the magnetic separator 114 such that it leaves the mixture of the plurality of carrier beads 108 in order to attach to the magnetic separator 114.

The magnetic separator 114 may be made of iron, nickel, cobalt, a magnetic alloy, and other magnetic materials. In an example the magnetic separator may be not be magnetized, but instead merely a material to which magnetized items are attracted. The magnetic separator 114 can include a ramp which is stationary that magnetized carrier beads slide along until they reach an end for removal into a waste area by either a removal mechanism or by falling due to gravity and reduced strength of their own magnetizing or forced distance from the magnetic material of the magnetic separator. In an example, the magnetic separator can include a moving surface such that once the magnetized carrier beads are attached, they are moved by the movement of the magnetic separator away from the developer sump 104. The magnetic separator 114 may include a moving flexible belt or a moving series of rigid panels arrange to approximate a flexible belt. The magnetic separator 114 may be completely magnetic or may be partially magnetic in that portions of the magnetic separator 114 may be magnetic while others are non-magnetic. In an example, the magnetic separator 114 may have magnetic metal underneath a non-magnetic covering. This covered magnetic metal may include a belt made of magnetic metal that is rubberized such that non-magnetic rubber is covering the surface of the magnetic separator 114. In an example, another non-magnetic material other than rubber may be used. This non-magnetic covering may function similarly to the roller 106 in that it moves the magnetized carrier beads to a position where the magnetic material is no longer present and the carrier beads may be released from the magnetic separator into a bead waste 122 (FIG. 1A).

The magnetic separator 114 may be inverted at a variety of angles. In an example, the magnetic separator 114 may be located such that it is approximately parallel to a fill line of settled carrier. In an example, the magnetic separator 114 may be angled so that it is a ramp and not an inverted ramp. In each of these examples, the magnetic separator may be moving or stationary to correspond to the sufficient attachment of magnetized carrier beads.

As discussed above, as carrier beads are used and repeatedly cycled through the roller 106 and developer sump 104, they become magnetized. Thus, by using a magnetic separator 114, the magnetized, older carrier beads are separated from fresher carrier beads. This can improve the function of the machine because over time, carrier beads can become impacted with toner particles which are stuck to the carrier beads not by electrostatic forces but through compressive and friction forces. Carrier beads with impacted toner particles are less able to triboelectrically charge the toner particles or to carry toner particles while on the roller 106 and can be less able to attach to the roller at all. Rather than having to dump out a mixture of old less usable carrier beads and fresher less used carrier beads, the use of a magnetic separator 114 enables more efficient removal of older carrier beads. Through more efficient separation techniques, replacement of fresher carrier is less frequent with fewer carrier beads used overall. This reduction in replacement frequency reduces the number of times a person has to service the printing machine. Further, the reduced use of carrier beads results in a cost savings from reduced demand for fresh carrier beads to be input.

Figure 2:
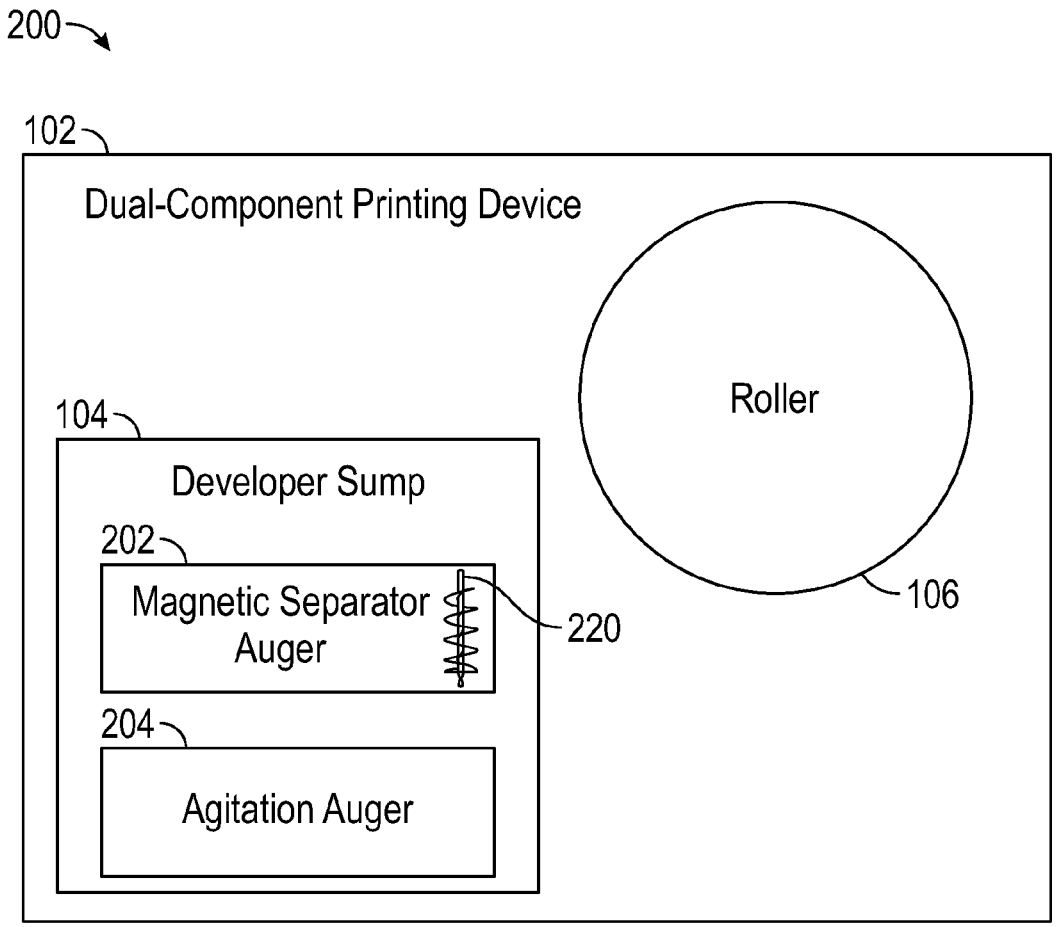
FIG. 2 is a block diagram of an example dual-component printing device that separates carrier beads with a magnetic separator auger.

FIG. 2 is a block diagram of an example dual-component printing device 102 that separates carrier beads with a magnetic separator auger 200. Like numbered items are as described with respect to FIG. 1A.

The older carrier beads may be separated by a magnetic separator auger 202. As the beads collect in the developer sump 104, attachment of toner and an appropriate ratio of toner to carrier involves mixing and agitating the collection of toner and carrier in the development sump 104. The use of at least one agitation auger 204 may be used in the development sump 104 in order to appropriately mix the toner and carrier. In an example, as fresh toner and carrier is added, the agitation auger 204 ensures an appropriate mix and composition of the fresh and old carrier and toner. The term auger can refer to an elongated screw shaped component that rotates in order to mix the carrier and toner. In an example, the auger may be approximately screw shaped such that a spiraling protrusion wraps around the lengthwise side of the auger (e.g., the magnetic separator auger 202 is approximately screw shaped such that a spiraling protrusion wraps around the length 220 of the magnetic separator auger 202). In an example, other variation of auger shapes can be used including non-continuous spiral wrapping, protrusions at random intervals, or other non-rotationally symmetrical shapes capable of mixing components while the auger is active.

The dual-component printing device 102 may include a number of agitation augers like the agitation auger 204 spaced at various intervals in the developer sump 104. In an example, the agitation auger 204 may be made of non-magnetic material. The magnetic separator auger 202 is made of magnetic material. As the magnetic separator auger 202 may be located in the development sump 104, it may be partially or completely submerged under carrier, toner, or a mix of both. As the magnetic separator auger 202 is magnetic, older carrier beads may be attracted to the magnetic separator auger 202. As the magnetic separator auger 202 may additionally have a screw shape that may rotate around the lengthwise axis. This rotational movement can move carrier beads that have been attracted to the magnetic separation auger 202 towards an end of the magnetic separation auger 202 based on the direction of the spiraling and the direction of rotation of the magnetic separation auger 202 and in some cases the agitation auger 204.

In an example, the magnetic separation auger 202 may extend outside of the developer sump 104 and attached carrier beads may be brushed off through physical means at the end of the magnetic separation auger 202. In an example, the magnetic separation auger 202 may have portions that are non-magnetic, in some cases the non-magnetic portions of the magnetic separation auger 202 may be at the ends. With these non-magnetic portions located at the end, the attached carrier beads may detach once they have reached the end of the magnetic separation auger 202. A separation point along the end of the magnetic separation auger 202 may be aligned with a bead waste. The bead waste may be a holding location or disposal mechanism for older carrier beads to be stored until they can be manually retrieved.

While the magnetic separation auger 202 may also move non-magnetized carrier beads, these beads will not be attracted to the magnetic separation auger 202 and as such, are unlikely to travel the full length of the magnetic separation auger 202. In an example, the magnetic separation auger 202 may be angled to travel upwards in order to further aid in separation between magnetized and non-magnetized carrier beads. Similarly to an inverted ramp, a magnetic separation auger 202 angled to travel upwards may push magnetized carrier beads upwards while fresher, non-magnetized carrier beads can fall back towards the developer sump 104.

Figure 3:
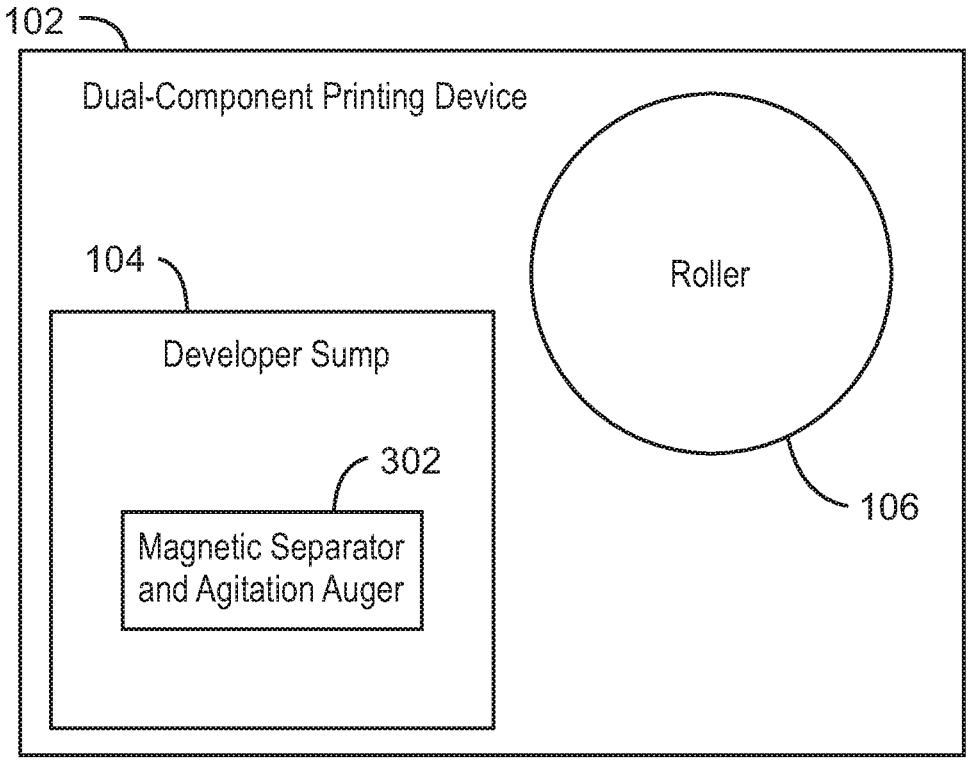
FIG. 3 is a block diagram of an example dual-component printing device that separates carrier beads with a magnetic separation and agitation auger.

FIG. 3 is a block diagram 300 of an example dual-component printing device 102 that separates carrier beads with a magnetic separation and agitation auger 302. Like numbered items are as described with respect to FIG. 1A.

The magnetic separation and agitation auger 302 may combine the roles of a magnetic separator with that of the agitation auger. In an example, there may be a single auger that both serves to agitate the mixture of carrier and toner as well as separate out magnetized carrier.

In an example, the magnetic separation and agitation auger 302 can be the sole auger in the developer sump 104. The magnetic separation and agitation auger 302 may be partially or completely below a target fill line for a carrier bead and toner particle mixture in the developer sump 104.

The term magnetic separation and agitation auger 302 refers to a screw shaped auger system that can attract magnetized carrier beads due to the materials that make up the magnetic separation and agitation auger 302. The agitation is primarily to ensure an appropriate mixture and triboelectric charging of the toner and carrier in the developer sump 104. In an example, the magnetic separation and agitation auger 302 can take a number of auger-like shapes that shunt, funnel, or otherwise push magnetized carrier beads away from the developer sump 104.

In an example, other shapes other than an auger could be used as a magnetic separator within the developer sump 104. This includes the number of variations as described above with respect to the magnetic separator 114. Further, a magnetic separator within the developer sump could include a separator arm that has a magnetic end that is retractably placed into the developer sump 104. The magnetic separator in a retractable arm shape could be used to both mix and separate old carrier beads from fresher carrier beads by attracting the older magnetized carrier beads as the arm moved through, into, and out of the developer sump 104. In an example, a magnetic separator in a retractable arm shape could be a single shaft rod, a multi-prong mixer, a sphere, a plurality of spheres, a rectangular prism, or any other shape or plurality of shapes smaller than the developer sump 104. In an example, a retractable arm could make use of a separate wiping element to remove magnetized carrier beads that are gripping the magnetic separator. In an example, a wiping element could be located separately near a bead waste so that as the carrier beads are wiped from the magnetic separator they fall or are guided towards the bead waste. In another possible example, the magnetic arm itself could resemble the roller 106 in that an outer non-magnetic casing could surround an inner core could be magnetic on one portion of the magnetic arm and not magnetic on the remaining portions. In this example, the non-magnetic casing could rotate around the partially magnetic inner core to move attracted carrier beads to a side of the magnetic separator they would no longer be attached. In this example, the magnetic separator arm could be inserted into the developer sump 0104 where magnetized carrier beads could attach. The magnetic separator arm could then be removed from the developer sump or at least above the mixture of carrier beads and toner so that non-magnetized carrier beads and toner could fall back into the developer sump 104. The magnetic separator arm could then be moved towards a bead waste or bead waste path where the non-magnetic outer casing could rotate so that magnetized carrier beads would no longer be near the magnetic inner core and could fall into the bead waste.

Figure 4:
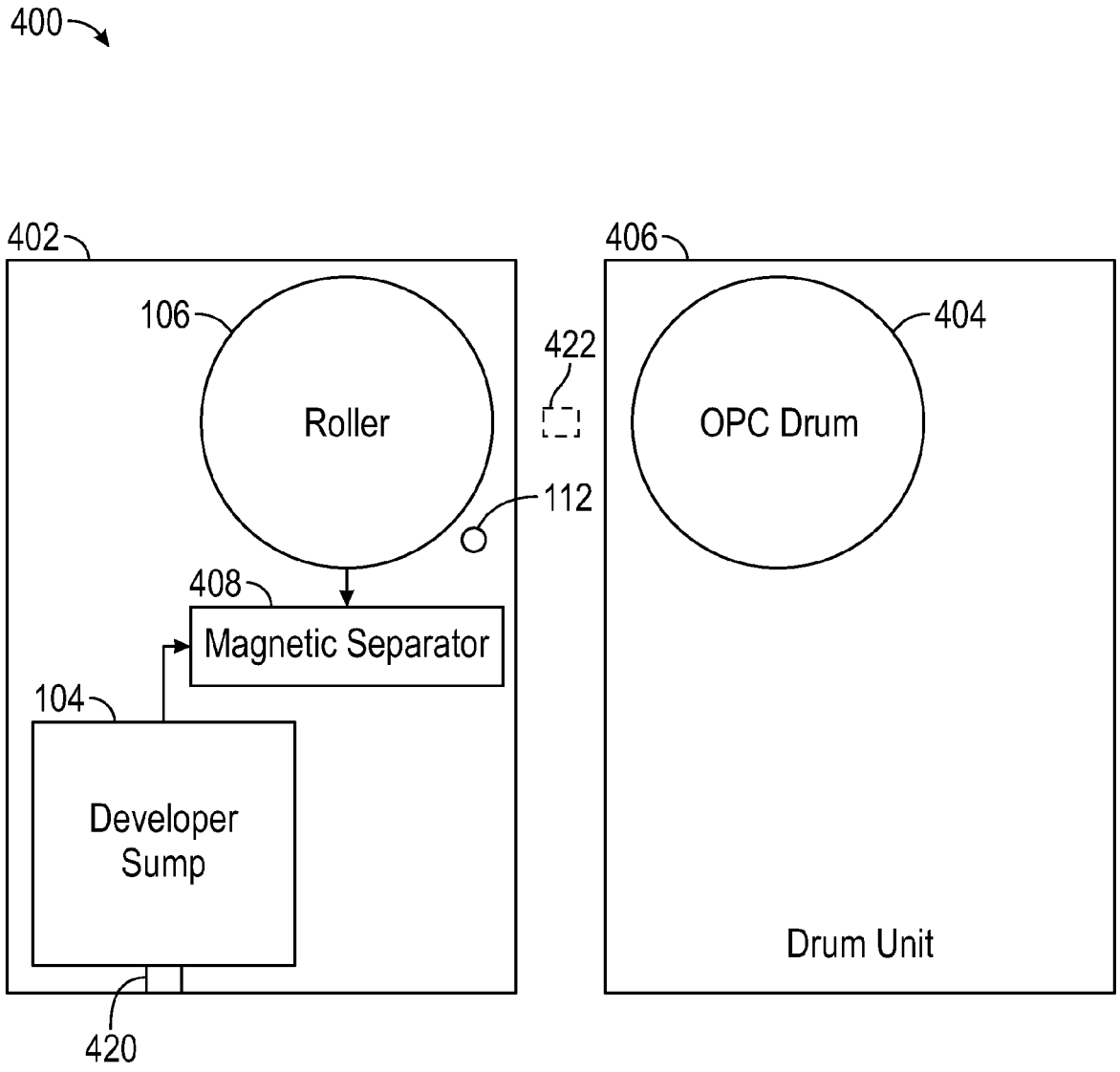
FIG. 4 is a block diagram of an example dual-component printing system that separates carrier beads with a magnetic separator located between the release point of a roller and the developer sump.

FIG. 4 is a block diagram of an example dual-component printing system 400 that separates carrier beads with a magnetic separator located between the release point of a roller and the developer sump. Like numbered items are as described with respect to FIG. 1.

As part of the dual-component printing system 400, a roller 106 in a developer unit 402 draws carrier beads from the developer sump 104 and can provide the toner to organic photographic carrier (OPC). The carrier beads on roller 106 are brought into contact (at an application point 422) with a rotating OPC drum 404 located in a drum unit 406 that applies the toner to the print medium in the dual-component printing system 400. In an example, as the roller of the developer 106 has provided the toner to the OPC, the carrier beads and some toner may return toward the development sump 104. At a release point from the roller 106, the carrier beads may be released. Of these released carrier beads, some may be magnetized through their repeated use on the roller 106. In an example, the magnets of the roller 106 may induce the carrier beads to become magnetized over time.

A magnetic separator 408 may be located between a release point and the developer sump 104. As discussed above, as carrier beads age and are used more frequently, they become magnetized. As they are released from the release point of the roller 106, any magnetized carrier beads would attach to the magnetic separator 408 located between the release point of the roller 106 and the developer sump. This magnetic separator 408 could be structurally similar to the magnetic separator of FIG. 1A, and the magnetic augers 202 and 302. The location of the magnetic separator 408 between the release point of the roller 106 and the development sump 104 could allow increase ease of movement of the magnetic separator 106 as it turns, retracts, or advances carrier beads towards a bead waste.

In an example, the magnetic separator 408 can be located in a free fall area for the carrier beads located between the release point of the roller 106 and the developer sump 104. In an example, the magnetic separator 408 could be located along a guided track, path, or moving belt that guides carrier beads towards a bead waste and away from the developer sump 104.

The dual-component printing system 400 may also include a carrier bead input port 420. The carrier bead input port 420 may be the same opening in the device as a toner input. As discussed above, old carrier beads that may have lost their efficacy due to impacted toner that blocks ability of carrier bead to effectively triboelectrically charge the attached toner and for toner to be removably attached to the carrier beads. Previously no means for separating these older carrier beads was possible and older, ineffective carrier beads were removed along with mixed in functional carrier beads and unused toner, resulting in wasted carrier and toner. By being able to selectively remove older, more magnetized beads, there is less ancillary disposal of still functional carrier beads, and thus less waste, and less need for refilling the carrier beads and toner.

In an example, the composition or mixture of carrier beads and toner can be measured on an ongoing basis so that as older carrier beads are filtered out or toner is used, the levels and mixture ratios can signal for additional carrier beads or toner to be added. In an example, a specific amount of carrier beads or toner may be added in a corresponding amount to how many carrier beads or toner has been removed from the developer sump. In an example, the amount of carrier beads or toner to add may correspond to a measurement made of the ratio of toner and carrier beads in the developer sump. In an example, the amount of carrier beads or toner to add may correspond to a measurement made of how full the development sump is along with the ratio of toner and carrier beads in the developer sump. For carrier beads, the amount of carrier beads to add may correspond to a measurement made of the how many magnetized carrier beads are removed from the developer sump or removed to the bead waste. These measurements may be made electronically, conductively, digitally, through weight or volume measurements, or other suitable measuring sensor mechanisms.

Figure 5:
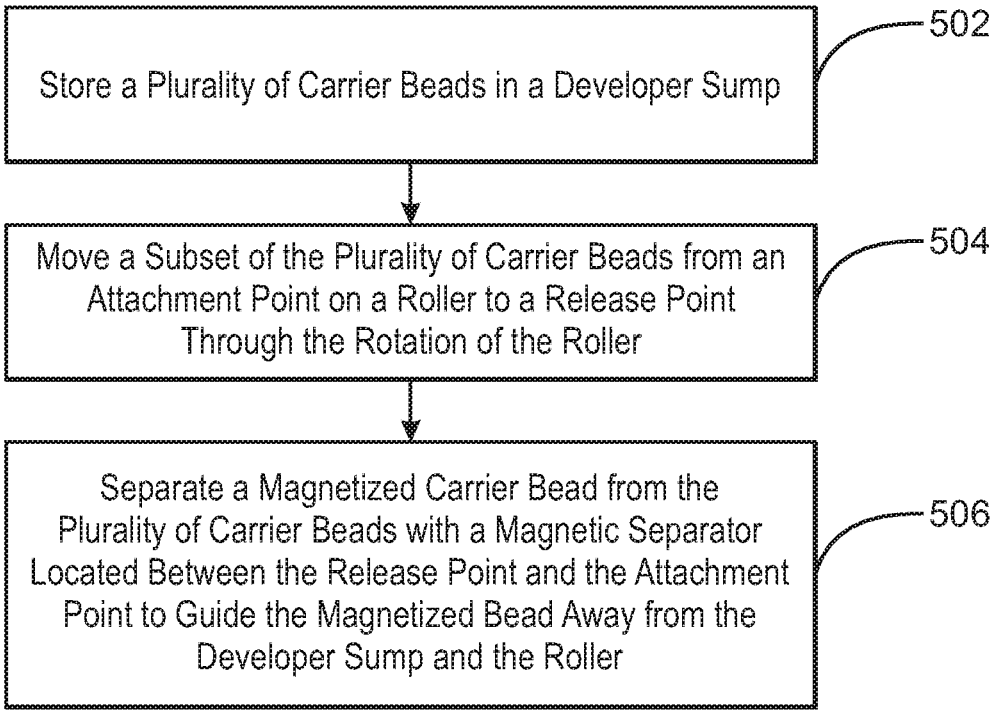
FIG. 5 is a flowchart of an example method for separating carrier beads by magnetic properties gained over time-of-use.

FIG. 5 is a flowchart of an example method 500 for separating carrier beads by magnetic properties gained over time-of-use. At block 502, a developer sump of a dual-component printing device stores a plurality of carrier beads. At block 504, a roller moves a subset of the plurality of carrier beads from an attachment point on the roller to a release point through the rotation of the roller, wherein the subset of the plurality of carrier beads return towards the developer sump after they are released at the release point.

At block 506, a magnetic separator separates a magnetized carrier bead from the plurality of carrier beads with a magnetic separator located between the release point and the attachment point to guide the magnetized bead away from the developer sump and the roller. In an example, the magnetic separator is an inverted magnetic ramp located above the developer sump relative to the ground or a surface the dual-component printing device is resting upon such that the magnetized carrier bead of the plurality of carrier beads is attracted to the inverted magnetic ramp that guides attracted carrier beads away from the developer sump and towards a bead waste. The magnetic separator may also be a moving magnetic separator to attract the magnetized carrier beads between the release point and the attachment point. In an example, the magnetic separator is located above the developer sump relative to the ground or a surface the dual-component printing device is resting upon. The magnetic separator may also be located to pass through the developer sump. In an example, the magnetic separator is located between the release point and the developer sump. The magnetic separator may also be a magnetic auger located in the developer sump that spins around the longest or longer dimension of the magnetic auger, the magnetic auger to attract the magnetized carrier bead of the plurality of carrier beads and move the carrier bead towards a bead waste. In this example, the magnetic separator may instead be a mixing auger in the developer sump. As far as location, the magnetic separator can be located between the release point and the developer sump.

The method 500 may further include delivering magnetized carrier beads to a bead waste where the dual-component printing device includes a fresh carrier bead input port (e.g., 420 in FIG. 4). In this example, the fresh carrier bead input port opens to allow fresh carrier beads to enter the developer sump in response to a detected amount of the plurality of carrier beads moved to the bead waste as a result of the magnetic separator.

While the present techniques may be susceptible to various modifications and alternative forms, the techniques discussed above have been shown by way of example. It is to be understood that the technique is not intended to be limited to the particular examples disclosed herein. Indeed, the present techniques include all alternatives, modifications, and equivalents falling within the scope of the following claims.

What is claimed is:

1. A dual-component printing device to separate carrier beads by magnetic properties gained over time-of-use, comprising:

a developer sump to hold a plurality of carrier beads and a toner;

a roller to remove the carrier beads and the toner from the developer sump, and move a subset of the plurality of carrier beads from an attachment point on the roller to a release point through a rotation of the roller, wherein the developer sump is to receive the subset of the plurality of carrier beads after a release of the subset of the plurality of carrier beads at the release point, and wherein the subset of the plurality of carrier beads comprises used carrier beads that mix with unused carrier beads in the developer sump; and a magnetic separator to guide a carrier bead that has become magnetized away from the developer sump, wherein the carrier bead that has become magnetized is part of the subset of the plurality of carrier beads, wherein the magnetic separator is an inverted magnetic ramp located above the developer sump relative to a surface the dual-component printing device is resting upon, such that the carrier bead that has become magnetized is attracted to the inverted magnetic ramp to guide the carrier bead that has become magnetized away from the developer sump and towards a bead waste.

2. The dual-component printing device of claim 1, wherein the magnetic separator is located above the developer sump relative to the surface the dual-component printing device is resting upon.

3. The dual-component printing device of claim 1, wherein the magnetic separator is located in the developer sump.

4. The dual-component printing device of claim 1, wherein the magnetic separator is located between the release point and the developer sump.

5. The dual-component printing device of claim 1, wherein the carrier bead that has become magnetized was magnetized responsive to use in the dual-component printing device.

6. A dual-component printing device to separate carrier beads by magnetic properties gained over time-of-use, comprising:

a developer sump to hold a plurality of carrier beads;

a roller to move a subset of the plurality of carrier beads from an attachment point on the roller to a release point through a rotation of the roller, the subset of the plurality of carrier beads to return towards the developer sump after the subset of the plurality of carrier beads is released at the release point; and a magnetic separator to guide a carrier bead that has become magnetized away from the developer sump and the roller, wherein the carrier bead that has become magnetized is part of the subset of the plurality of carrier beads, wherein the magnetic separator is an inverted magnetic ramp located above the developer sump relative to a surface the dual-component printing device is resting upon, such that the carrier bead that has become magnetized is attracted to the inverted magnetic ramp to guide the carrier bead that has become magnetized away from the developer sump and towards a bead waste.

7. The dual-component printing device of claim 6, wherein the developer sump comprises a mixing auger.

8. The dual-component printing device of claim 6, wherein the developer sump is to receive the subset of the plurality of carrier beads after a release of the subset of the plurality of carrier beads at the release point, and wherein the subset of the plurality of carrier beads comprises used carrier beads that mix with unused carrier beads in the developer sump.

9. A dual-component printing system to separate carrier beads by magnetic properties gained over time-of-use, comprising:

a drum unit comprising an organic photo conductor (OPC);

a developer unit comprising:

a developer sump to hold a plurality of carrier beads;

a roller to move a subset of the plurality of carrier beads from an attachment point on the roller, across an application point where a toner is applied to the OPC of the drum unit, and to a release point through a rotation of the roller, wherein the subset of the plurality of carrier beads is to return towards the developer sump after the subset of the plurality of carrier beads is released at the release point; and a magnetic separator to guide a carrier bead that has become magnetized away from the developer sump and the roller, wherein the carrier bead that has become magnetized is part of the subset of the plurality of carrier beads, wherein the magnetic separator is an inverted magnetic ramp located above the developer sump relative to a surface the dual-component printing system is resting upon such that the carrier bead that has become magnetized is attracted to the inverted magnetic ramp to guide the carrier bead that has become magnetized away from the developer sump and towards a bead waste.

10. The dual-component printing system of claim 9, wherein the magnetic separator is to attract the carrier bead that has become magnetized from the developer sump.

11. The dual-component printing system of claim 9, wherein the developer sump is to receive the subset of the plurality of carrier beads after a release of the subset of the plurality of carrier beads at the release point, and wherein the subset of the plurality of carrier beads comprises used carrier beads that mix with unused carrier beads in the developer sump.

* * * * *